United States Patent [19]

Quinton et al.

[11] 4,299,325

[45] Nov. 10, 1981

[54] DOCUMENT DETECTOR AND COLLECTOR

[75] Inventors: Brian M. Quinton, Basingstoke, England; Emanuel R. Quinci, Dix Hills, N.Y.; Henry Harrison, deceased, late of Locust Valley, N.Y., by Dorothy Harrison, administratrix

[73] Assignees: Halm Industries Co., Inc., Glen Head, N.Y.; De La Rue Giori S.A., Lausanne, Switzerland

[21] Appl. No.: 94,446

[22] Filed: Nov. 15, 1979

Related U.S. Application Data

[63] Continuation-in-part of Ser. No. 846,594, Oct. 28, 1977.

[51] Int. Cl.[3] ..... B07C 5/34

[52] U.S. Cl. ..... 209/553; 209/3.3; 209/583; 209/643; 271/196; 271/279

[58] Field of Search ..... 209/3.1, 3.3, 553, 569, 209/583, 643, 900, 922, 933; 198/733; 271/94, 96, 195, 196, 279, 302

[56] References Cited

U.S. PATENT DOCUMENTS

| | | | |
|---|---|---|---|
| 1,968,941 | 8/1934 | Hall et al. | 271/196 X |
| 2,528,123 | 10/1950 | Dyken | 271/96 X |
| 2,686,052 | 8/1954 | Winkler et al. | 271/94 X |
| 2,804,974 | 9/1957 | Noon | 209/553 |
| 2,867,438 | 1/1959 | Hori | 271/196 |
| 2,915,308 | 12/1959 | Matzen | 271/196 X |
| 3,180,479 | 4/1965 | Meeks et al. | 198/733 |

*Primary Examiner*—Robert J. Spar
*Assistant Examiner*—Fred A. Silverberg
*Attorney, Agent, or Firm*—James P. Malone

[57] ABSTRACT

Document detector and collector for detecting and collecting identifiable documents from a high speed stream of documents. A plurality of documents including identifiable documents are fed along a path. A detector detects the identifiable documents. A table is mounted above the document path to receive the identifiable documents. A first vacuum wheel responsive to the detector, removes the identifiable documents and feeds the removed documents to a second vacuum wheel. The second vacuum wheel delivers the documents to the delivery table.

2 Claims, 7 Drawing Figures

DOCUMENT DETECTOR AND COLLECTOR

This Application is a Continuation-in-part of Ser. No. 846,594, filed Oct. 28, 1977, having the same title.

BACKGROUND ART

This invention relates to document detector and collector means and more particular to means for detecting identifiable documents and removing them from a fast moving stream of documents.

DISCLOSURE OF INVENTION

The printing of currency bills, bonds and stock certificates and similar documents is generally done by printing sheets of the documents. The sheets are then visually inspected for defects in the printing. The inspector identifies the rejects by marking them with fluorescent ink. The sheets are then cut up and fed into the sorter machine where good notes are separated from bad notes before the documents are fed to a numbering press, where the numbers are printed.

After the sheets have been cut up into the individual documents they are fed on a conveying means past the detector to detect the rejects. In the prior application referred to, when the detector detects a reject it actuates a rotary vacuum sucker which lifts the reject from the high speed stream of documents and feeds the rejects to a magazine. The rejects are counted enroute to the magazine.

It was found that the use of a magazine to receive the rejects was not practical. Since the apparatus is operating at high speed the magazine will be quickly filled and will require almost constant attendance by an operator to unload the magazine.

In the present invention the rejected documents are fed from the first vacuum wheel to a second vacuum wheel which then delivers them to a delivery table which is downstream from the vacuum means. With the present arrangement it is not necessary to continually unload a magazine.

Accordingly, a principal object of the invention is to provide new and improved document detecting and collecting means.

Another object of the invention is to provide new and improved document detecting and collecting means to collect identifiable documents from a high speed stream of documents.

Another object of the invention is to provide new and improved document detecting and collecting means where the identifiable documents are marked with fluorescent ink.

Another object of the invention is to provide new and improved document detecting and collecting means where rejected documents are marked comprising a detector connected to actuate a rotary vacuum sucker which removes the reject from the high speed stream of documents.

Another object of the invention is to provide new and improved document processing means comprising, a chain with pushers for guiding a plurality of documents along a path with predetermined positive registration at high speed, means mounted along said path for detecting identifiable documents, first vacuum lifting means mounted above said chain, second vacuum lifting means mounted above said first vacuum lifting means, a table mounted downstream from said second vacuum lifting means to receive said identifiable documents, valve means connected to said detecting means and said first and second vacuum lifting means to connect vacuum to said first and second vacuum lifting means to remove said identifiable documents upwardly and feed said removed documents to said table while registration is maintained by said chain of the documents which are not removed, said vacuum means being moved at high speed, and means to synchronize the document guiding chain means and the peripheral speed of the first and second vacuum lifting means.

BRIEF DESCRIPTION OF DRAWINGS

These and other objects of the invention will be apparent from the following specification and drawings of which.

BEST MODE FOR CARRYING OUT THE INVENTION

Figure 1:
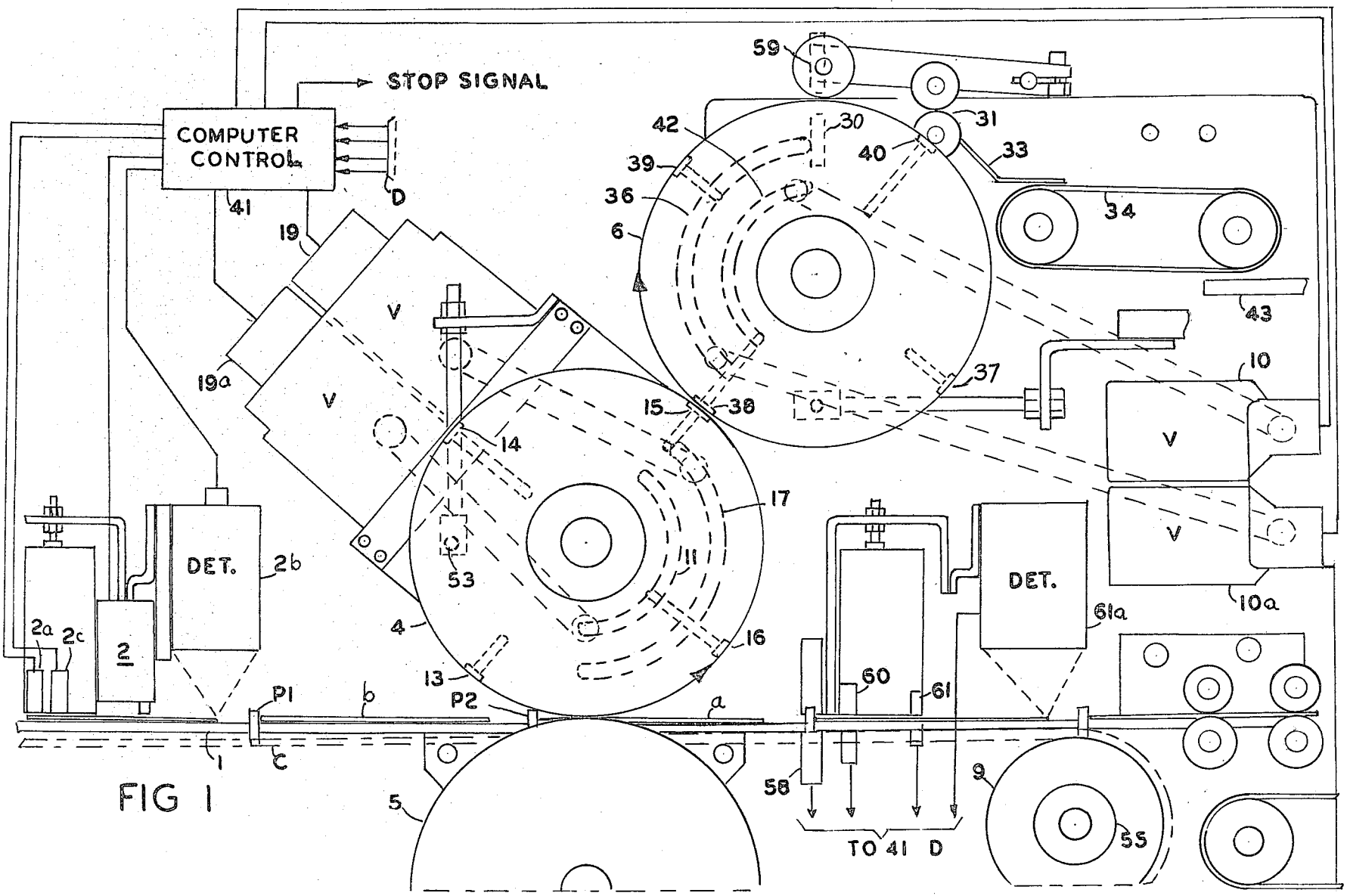
FIG. 1 is a side view of an embodiment of the invention.

Referring to FIG. 1, the documents a, b, etc., are fed down rails 1, in the direction of the arrow by chain C with pushers P1, P2, etc. The chains are mounted on sprockets 8, 9, which are driven in conventional manner.

Rejected documents are identifiable with fluorescent ink. A detector 2 is mounted above the rail 1. The detector 2, may be a conventional device to detect fluorescent ink. Alternatively, alternating magnetic field detectors can be used if the identifying stickers are of material which conducts eddy currents.

The detector 2*a* is a photo electric detector adapted to detect double documents that is where one document is lying on top of the other. In such a case, the apparatus is stopped by the micro processor control 41. The detector 2*b* is another photo electric detector which is designed to detect certain indicia on documents to determine if the document has the proper orientation. Photo electric detector 2*c* is a counter.

After passing the detector 2, the documents are fed between a rotary vacuum wheel 4 having four vacuum ports, 13, 14, 15 and 16, and an idler roller 5. If a reject is detected by the detector 2, a solenoid operated valve 19 is actuated which connects a source of vacuum to the vacuum wheel 4. The vacuum wheel 4, then picks up the rejected document and carries it counter-clockwise in FIG. 1, into contact with a second vacuum wheel 6.

The second vacuum wheel 6 also has four vacuum ports, 37, 38, 39 and 40, and the vacuum wheels 4 and 6 are arranged so that the vacuum ports of the wheel 6 will be connected to the vacuum source at the same time as the vacuum in the wheel 4 is released, so that the document is transferred from the wheel 4 to the wheel 6. The document is then moved clockwise in FIG. 1, by wheel 6, past the counter 30, which may be conventional. The document then passes between the rollers 31, 32 and falls down past guide 33, on to a moving belt 34, which deposits the document on the delivery table, 43.

In the vacuum wheel 4, vacuum is supplied to the ports 13 and 15 by means of the outer arcuate slot 17. Ports 16 and 14 are connected to the inner slot 11. The slots 11 and 17 are connected to the valves 19 and 19*a*.

The vacuum ports are indexed so as to come into contact with the documents near their leading edge. Therefore, when a reject is detected by the detector 2, a micro processor 41 or other control is triggered and vacuum is turned on by the valve 19 and connected to the arcuate slot 11 which is in a stationary portion of the wheel assembly so that vacuum is applied to the port as it comes in contact with the leading edge of the document to be removed. Vacuum is applied by valve 19 to wheel 4 for approximately 140° of the cycle of wheel 4 for each reject detected. Vacuum is then applied by micro processor 41 to wheel 6 for approximately 140° of the cycle.

The wheel 6 also has arcuate slots 36 and 42 for supplying vacuum to the vacuum ports on the wheel 6. The vacuum is applied to the wheel 6 at approximately 140° of the cycle later than to wheel 4, i.e. when the document enters the bite between the wheels 4 and 6. The vacuum is applied to the arcuate slot 36 so that the port 37 will pick up the document and move it clockwise. When the port 37 leaves the upper end of the slot 36, then the vacuum is released and the document passes between the rollers 31 and 32 and on to the delivery conveyor 34. The next port 40 is connected to inner arcuate slot 42. Valve 10 is connected to slot 42 and valve **10*a* is connected to slot 36 of wheel 6. All detectors and valves are connected to micro processor 41** or other controller.

If the next document is to be picked up, vacuum is applied via valve **19*a* to inner slot 11. Vacuum wheel 6** operates in the same manner.

Figure 2:
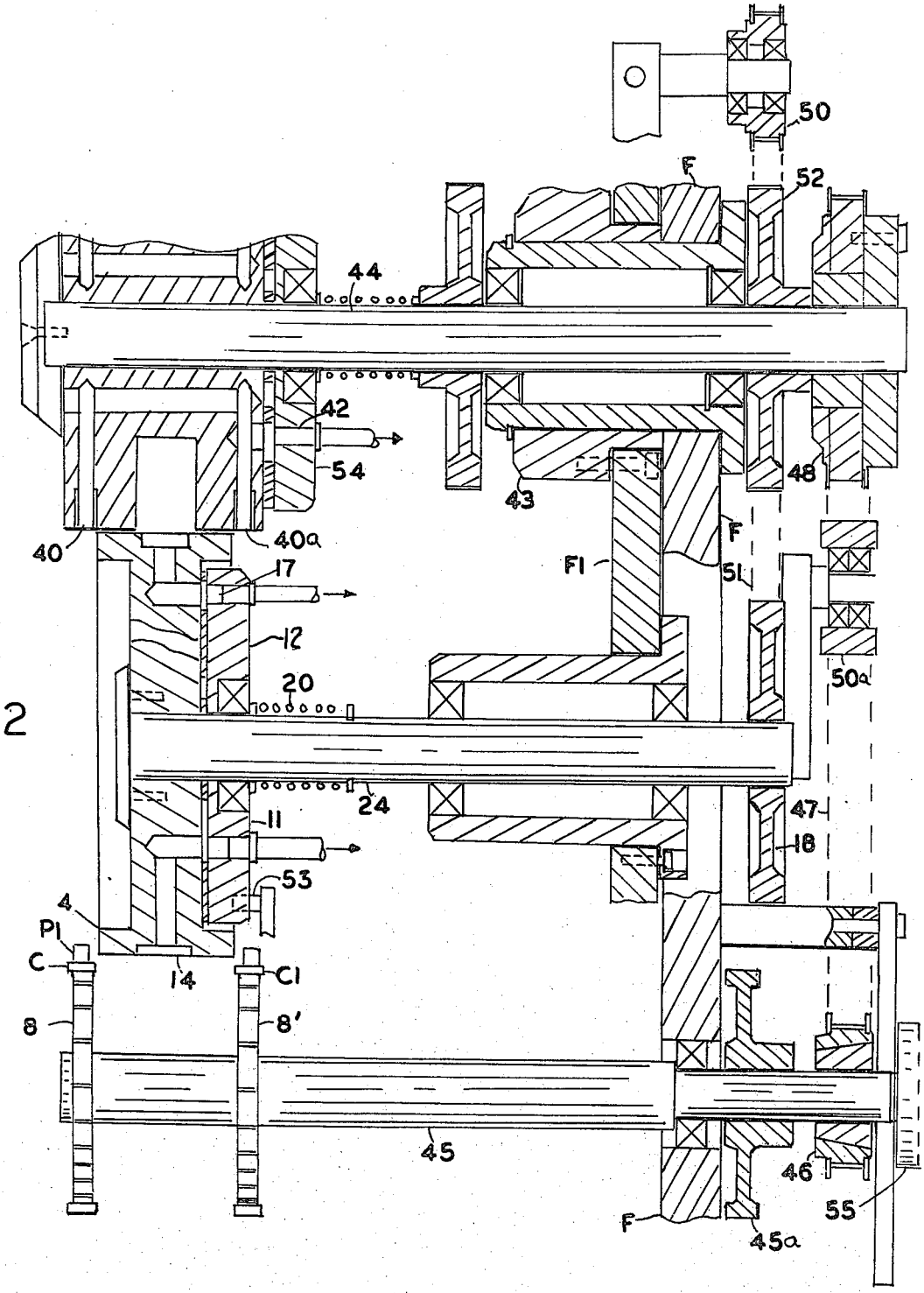
FIG. 2 is a side view illustrating the vacuum wheels.
Figures 3, 4A, 4B, 4C, 4D:
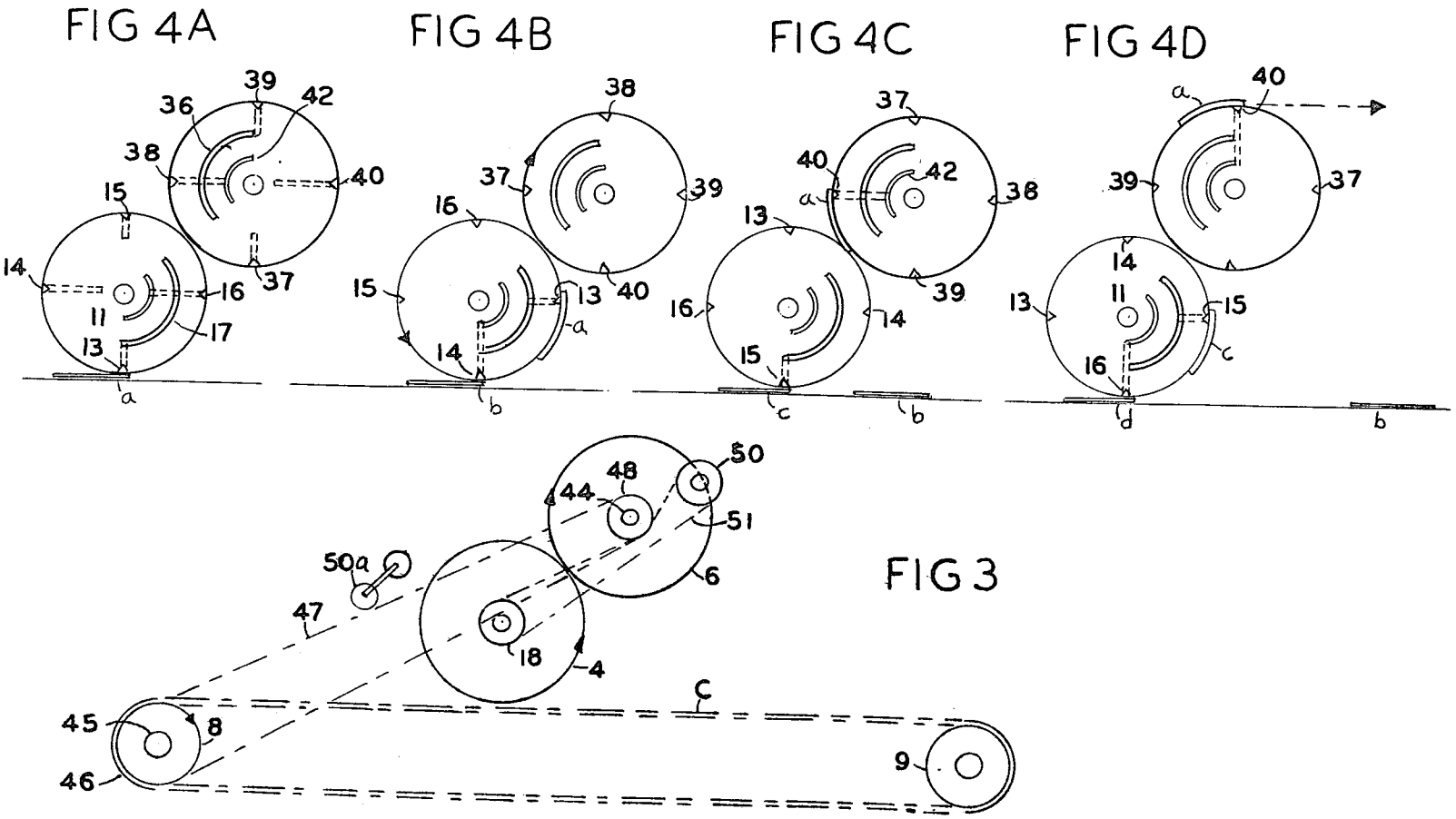
FIG. 3 is a schematic view illustrating the power drive.
FIGS. 4A to 4D are diagrams illustrating the operation of the invention.

Referring to FIGS. 2, 3, and 4, FIG. 2 shows a side view of the vacuum sucker assembly. The vacuum wheel 4 is mounted on shaft 24 which is driven by the driven gear 18. The shaft 24 is mounted in a frame member F1., which is pivotally mounted to the stationary side frame F by means of the bearing assembly 43. This permits the wheels 4, 6, assembly to be rotated up out of the way. The bearing assembly 43 also mounts the shaft 44, which mounts the upper vacuum wheel 6.

Power is applied to the vacuum wheels 4 and 6 by means of driven gear **45*a* on shaft 45 which is connected by means of the gear 46, timing belt 47, to the gear 48, which rotates the shaft 44 and wheel 6. The lower vacuum wheel 4 is driven by shaft 24 which in turn is driven by the gear 18 which is driven by the timing belt 51, from gear 52 on shaft 44. Timing belt 51 is connected between gear 18 and sprocket 50 so that the back side of timing belt 51 is driven by gear 52, therefore wheels 4 and 6 rotate in opposite directions. See FIG. 4. Idler sprocket 50*a* tensions the timing belt 47**.

Referring to the vacuum wheel 4, it has four suckers 13, 15, etc. The sucker port 13 is connected to an outer arcuate slot 17 in the stationary valve plate 12. The sucker port 15 on the same diameter will also be connected to the outer slot 17. The other pair of ports 14 and 16 are connected to the inner arcuate vacuum slot 11. FIG. 3 has been modified to illustrate this connection. The valve plate 12 is held against the wheel 4 by means of the spring 20 and is locked against rotation by means of a pin 53, mounted on the frame.

The wheel 6 is similarly mounted on shaft 44. It has two rows of vacuum ports 40, **40*a*, etc. The ports 40, 40*a* are connected to inner slot 42 of the vacuum valve 54. The ports opposite to the ports 40, 40*a* on the same diameter are also connected to the slot 42 of valve plate 54. The other pairs of ports are connected to the outer slot 36, similarly to the arrangement in the vacuum wheel 4. Chains C and C1 are mounted on sprockets 8 and 8', mounted on driven shaft 45. Chains C, C1 run over another set of sprockets 9** at the other end of the chain.

It is necessary to have inner and outer vacuum slots. For instance, assuming the outer slot 17 is connected to vacuum and picks up a first document, this slot is energized for approximately 140° which is more than one-quarter cycle. If the next document is not to be picked up, the next port cannot be connected to the outer vacuum slot 17, since it would be picked up also. Therefore, the alternate pairs of ports are connected to the outer slot 17 and the inner slot 11.

The vacuum slots in the wheel 4 define arcs of approximately 140°. The vacuum slots in the wheel 6 also define arcs of approximately 140°. Therefore, when the detector 2 is actuated, valves 19, **19*a* applies vacuum either to the slot 17 or the slot 11 for slightly more than 140°. Valves 19, 19*a* are connected to detector 2 through micro processor 41 or other control which relays the detector signal approximately 140° of the cycle. The valves 10, 10*a* apply vacuum to the wheel 6, approximately 140° later than it is applied the vacuum to the wheel 4. This vacuum is applied for approximately 140° travel of the wheel 6 at which time the vacuum is released and the documents pass between the rollers 31, 32, and down over the guide 33 on a conveyor 34 and receiving table 43. The micro processor is synchronized by signal generator 55, on shaft of chain drive sprocket 8**.

Counter 58, FIG. 1, counts the non-selected documents and counter 59 counts the selected documents. Detector 60, detects double thickness of all documents. In the event of double thickness the machine is shut off by the micro processor control 41. Fluorescent detector 61 detects any fluorescent marked documents which have not been removed. Detector **61*a* is a photo electric detector which checks the orientation of the document. These detectors are connected to micro processor 41** or other controls by cable D.

FIGS. 4A, 4B, 4C and 4D illustrate the operation of the invention.

FIG. 4A illustrates the document a, about to be picked up by the port 13 of wheel 4. The document a, has been selected by the detector 2 and vacuum has been applied to the outer slot 17.

FIG. 4B is one-quarter cycle after FIG. 4A. The document a, is being carried around by the wheel 4. Assuming the document b, is not to be picked up, the port 14 is connected to the inner slot 11, which is not energized with vacuum since the document b, is not to be picked up.

FIG. 4C is one-quarter cycle after FIG. 4B. The document c, is being picked up by the port 15 which is connected to the outer vacuum slot 17. Document a, has been transferred to the wheel 6 and has been picked up by the port 40 which is connected to vacuum slot 42. Document b, has not been picked up and is riding on the chain C with positive registration for further printing operations.

FIG. 4D is one-quarter cycle after FIG. 4C. Document c, is being carried around by the port 15 which is connected to the outer vacuum slot 17. If the document d, is to be picked up the inner slot 11, will be connected to vacuum which will apply vacuum to the port 16.

It is claimed:

1. Document processing means comprising, a chain with pushers for guiding a plurality of documents along a path with predetermined positive registration at high speed, means mounted along said path for detecting identifiable documents, first vacuum lifting means mounted above said chain, second vacuum lifting means mounted above said first vacuum lifting means in operative contact with said first vacuum means, receiving means mounted downstream from said second vacuum lifting means to receive said identifiable documents, valve means connected to said detecting means and said first and second vacuum lifting means to connect vacuum to said first and second vacuum lifting means to remove said identifiable documents upwardly and feed said removed documents to said receiving means while registration is maintained by said chain of the documents which are not removed, said vacuum means being moved at high speed, and means to synchronize the document guiding chain speed and the peripheral speed of the first and second vacuum lifting means, the first vacuum lifting means comprising, a first wheel having four vacuum ports and a first valve plate having inner and outer arcuate slots for connecting vacuum to alternate ports.

2. Apparatus as in claim 1 wherein the second vacuum lifting means comprises:

a second wheel having four vacuum ports and a second valve plate having inner and outer arcuate slots for connecting vacuum to the ports.

* * * * *